US007815513B2

(12) United States Patent
Rieber

(10) Patent No.: US 7,815,513 B2
(45) Date of Patent: Oct. 19, 2010

(54) ENCLOSED SLIDE

(76) Inventor: Frederick Rieber, 4625 Clark St., Hamburg, NY (US) 14075-3903

( * ) Notice: Subject to any disclaimer, the term of this patent is extended or adjusted under 35 U.S.C. 154(b) by 500 days.

(21) Appl. No.: 11/948,510

(22) Filed: Nov. 30, 2007

(65) Prior Publication Data

US 2009/0143154 A1 Jun. 4, 2009

(51) Int. Cl.
*A63G 21/00* (2006.01)
*A63G 21/18* (2006.01)

(52) U.S. Cl. ..... 472/116; 472/117; 285/411; 285/420

(58) Field of Classification Search ..... 472/13, 472/116, 117, 128; 285/134.1, 135.1–135.5, 285/405, 406, 411, 420, 184, 185; 182/48, 182/49

See application file for complete search history.

(56) References Cited

U.S. PATENT DOCUMENTS

| | | | | |
|---|---|---|---|---|
| 1,534,333 | A | 4/1925 | Sturges | |
| 1,754,375 | A | 4/1930 | Sturges | |
| 2,013,312 | A | 8/1935 | McIntire | |
| 3,498,325 | A | 3/1970 | Ashton et al. | |
| 3,850,210 | A | 11/1974 | Buxton | |
| 3,877,491 | A | 4/1975 | Thastrup | |
| 4,111,492 | A | 9/1978 | Mraz | |
| 4,135,738 | A | 1/1979 | Clements | |
| 4,231,398 | A | 11/1980 | Gibbons | |
| 4,290,463 | A | 9/1981 | DeGeorge et al. | |
| 4,379,551 | A | 4/1983 | Ahrens | |
| 4,410,281 | A | 10/1983 | Crookes | |
| 4,487,411 | A | 12/1984 | Ahrens | |
| 4,553,308 | A | 11/1985 | Botsolas | |
| 4,844,133 | A | 7/1989 | von Meyerinck et al. | |
| D328,119 | S | 7/1992 | Matsch | |
| 5,226,864 | A | 7/1993 | Showers | |
| 5,379,804 | A | 1/1995 | Dunn et al. | |
| D429,788 | S | 8/2000 | Sutton et al. | |
| 6,692,041 | B1 * | 2/2004 | Coulas, Sr. | 285/406 |
| 6,758,500 | B2 * | 7/2004 | Lehnhardt | 285/365 |
| 7,488,010 | B2 * | 2/2009 | Wellman et al. | 285/364 |
| 2006/0194638 | A1 | 8/2006 | Hunter | |

* cited by examiner

*Primary Examiner*—Kien T Nguyen
(74) *Attorney, Agent, or Firm*—Rader, Fishman & Grauer PLLC

(57) ABSTRACT

An enclosed slide extending between a deck located above a ground surface and the ground surface. The enclosed slide includes a number of elongate sections extending between the deck and the ground surface. The sections are connected together in abutting end-to-end relations respectively. Each section includes a body and one or more flanges extending outwardly from the body and ending in notched edges, each flange being positioned substantially at one of the ends. The enclosed slide also includes a number of clamp rings. Each clamp ring includes one or more notched portions for mating with the notched edges of each pair of adjacent flanges respectively. Each clamp ring is adapted for securing the adjacent flanges in each pair to each other respectively.

20 Claims, 15 Drawing Sheets

ENCLOSED SLIDE

FIELD OF THE INVENTION

This invention is related to enclosed slides.

BACKGROUND OF THE INVENTION

Enclosed slides intended for recreational use are known, and a wide variety are available. In general, the known enclosed slides are made up of a number of segments. Typically, the segments are assembled at the site, to provide a slide bed with curves and slopes as desired. However, assembling the segments is usually relatively slow and painstaking, because identification of the segments, and appropriate positioning of the segments relative to each other during assembly, tend to be time-consuming, and may involve a certain amount of trial and error.

SUMMARY OF THE INVENTION

In its broad aspect, the invention provides an enclosed slide extending between a deck located above a ground surface and the ground surface. The enclosed slide includes an elongate slide bed extending between a top end thereof proximal to the deck and a bottom end thereof proximal to the ground surface. The slide bed includes a floor portion and a roof portion defined by a number of elongate sections, each section extending between a first end and a second end. The sections are connected together in abutting end-to-end relations respectively in which two of the sections are positioned end-to-end. Each section has a body defining a portion of the slide bed and one or more flanges extending outwardly from the body and ending in notched edges, respectively. Each flange is positioned substantially at one of the ends. The flanges positioned at each of the abutting two ends of respective sections comprise a pair of the flanges adjacent to each other. The notched edges on each pair of adjacent flanges are substantially aligned with each other. The enclosed slide also includes a plurality of clamp rings, each clamp ring including one or more notched portions for mating with the notched edges of each pair of adjacent flanges respectively. Each clamp ring is adapted for securing the adjacent flanges in each pair to each other respectively.

In another aspect, each notched edge includes a number of first teeth. Each first tooth is spaced apart from the first teeth proximal thereto by first notches. Also, the notched portion includes a number of second teeth, and each second tooth is spaced apart from the second teeth proximal thereto by second notches. The second teeth and the second notches are sized and positioned to mesh with the first teeth and the first notches in the notched edges.

In yet another aspect, each clamp ring includes one or more locking mechanisms for locking the notched portion of each clamp ring and the notched edges of each pair of adjacent flanges together when the first teeth and the first notches are meshed with the second notches and the second teeth respectively, to substantially maintain each pair of adjacent flanges in a predetermined relation relative to each other.

In yet another of its aspects, the enclosed slide includes a number of indicators disposed on the body of each section for rotationally positioning each section relative to each section abutting thereto in a preselected relation relative to each other.

In another of its aspects, the invention provides a kit of parts for an enclosed slide with a predetermined configuration. The kit includes a number of elongate sections, a number of clamp rings, and instructions for connecting the sections in abutting end-to-end relations to form the predetermined configuration.

BRIEF DESCRIPTION OF THE DRAWINGS

The invention will be better understood with reference to the attached drawings, in which.

DETAILED DESCRIPTION

Figure 1:
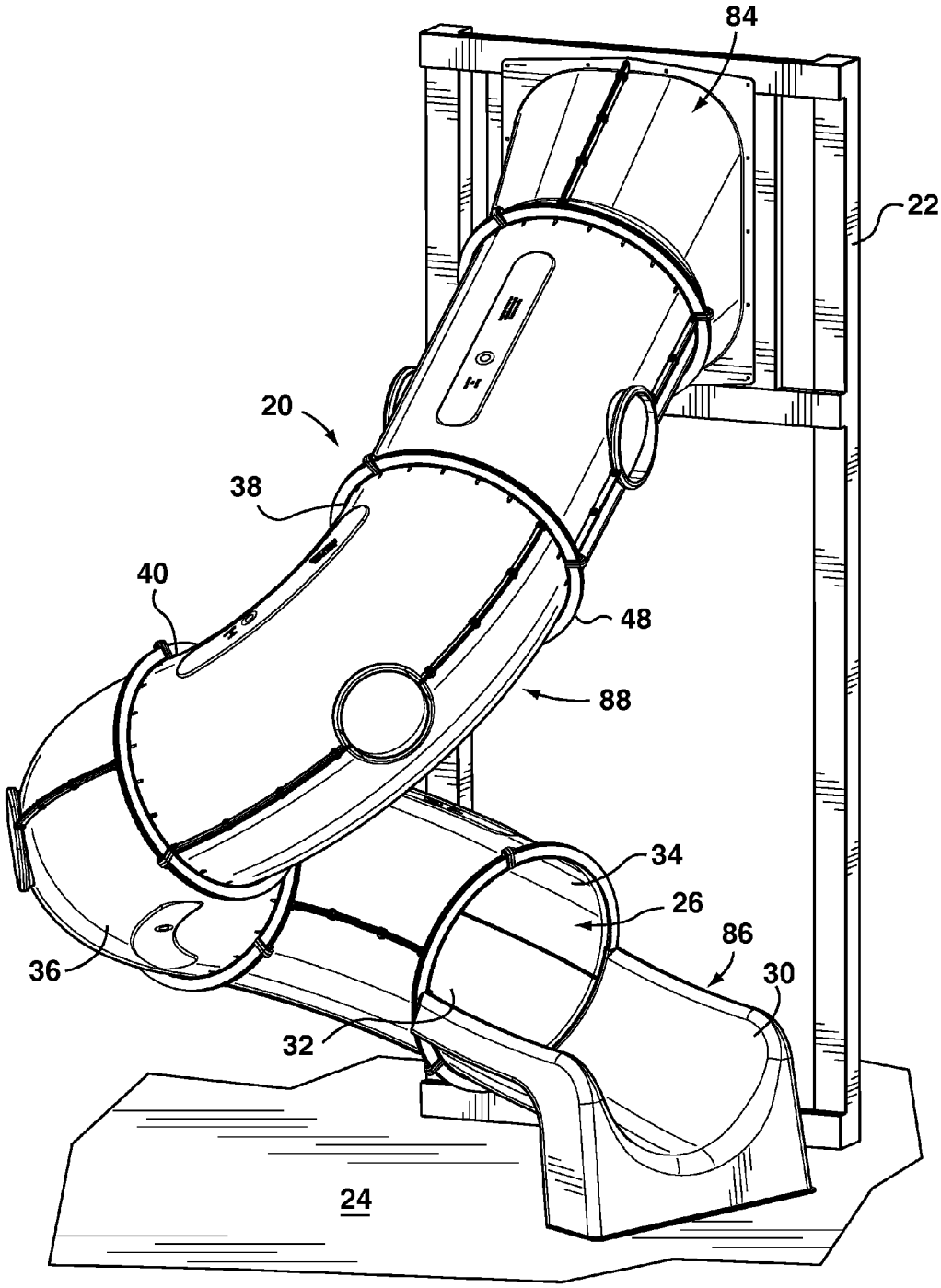
FIG. 1 is an isometric view of an embodiment of an enclosed slide of the invention after assembly thereof.
Figure 2:
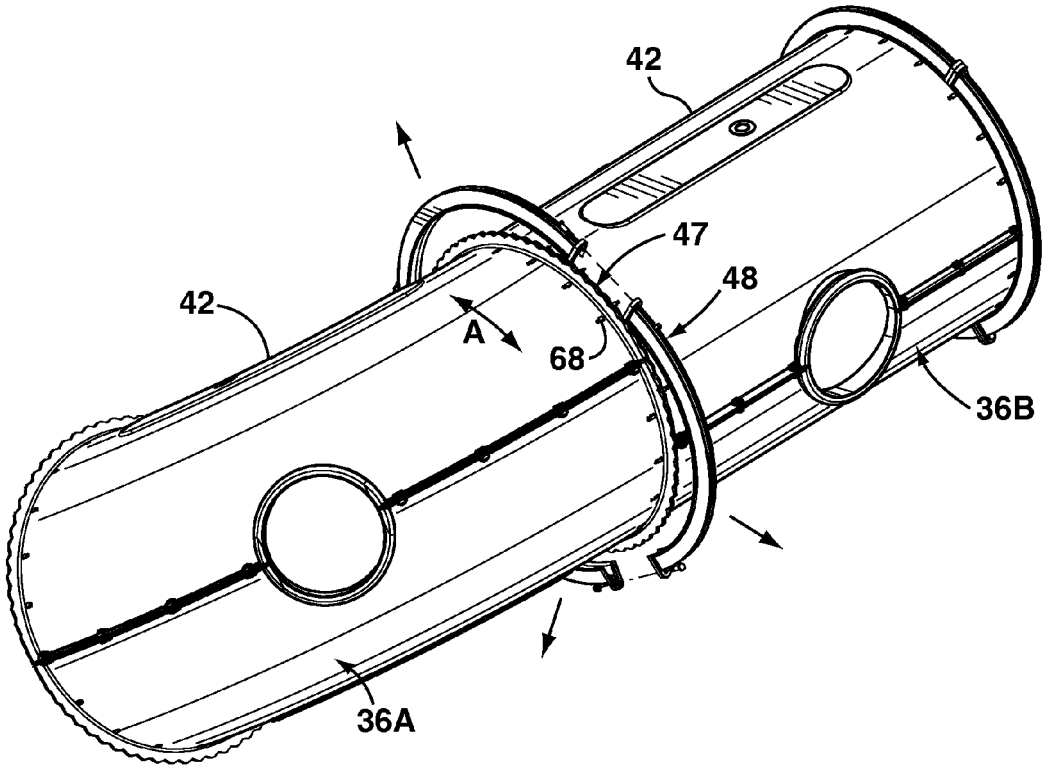
FIG. 2 is an isometric view of two sections positioned end-to-end, with a pair of flanges positioned adjacent to each other and an embodiment of a clamp ring of the invention disengaged from the flanges, drawn at a larger scale.
Figure 2A:
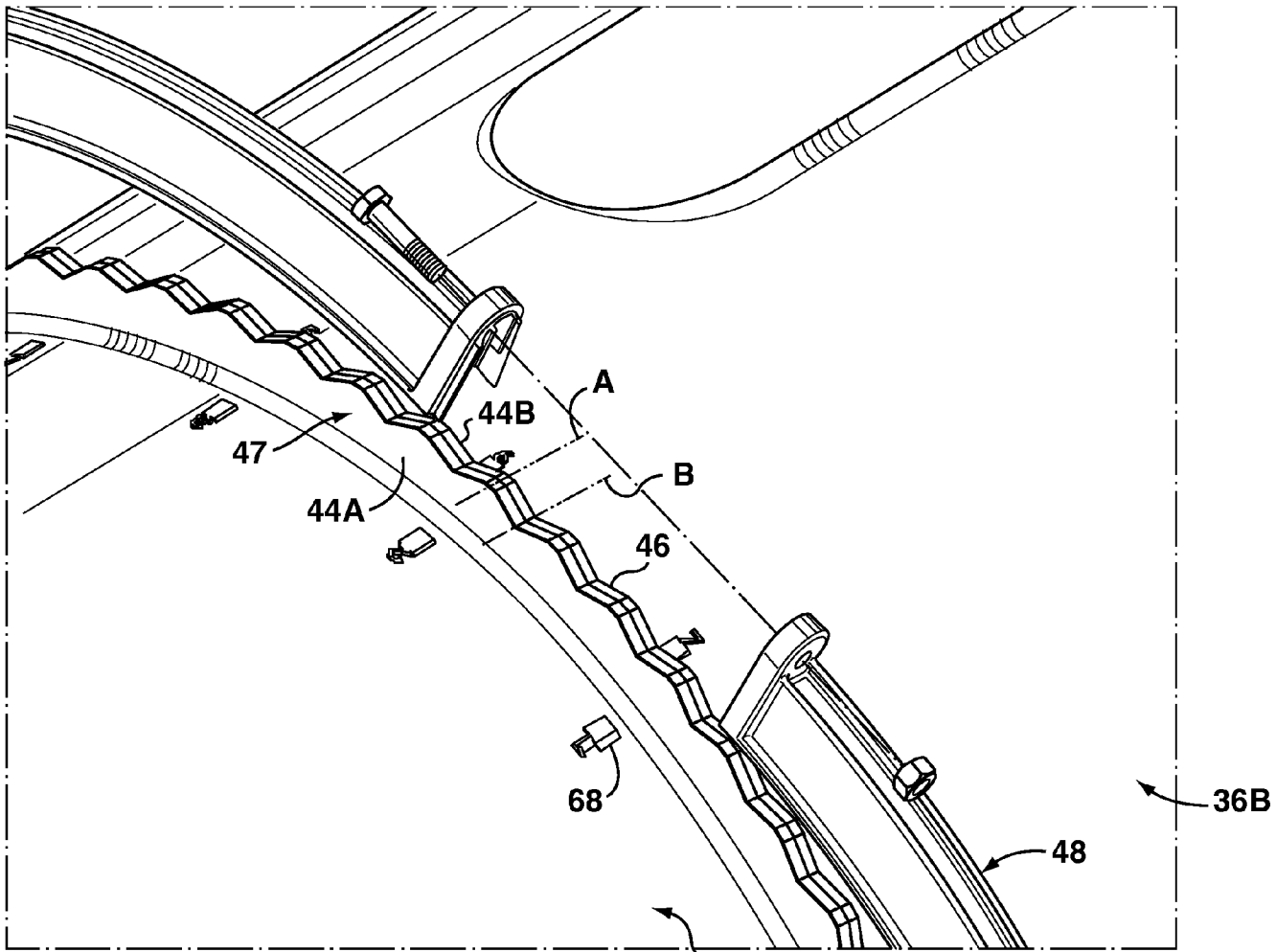
FIG. 2A is an isometric view of a portion of the pair of adjacent flanges of FIG. 2, drawn at a larger scale.
Figure 3:
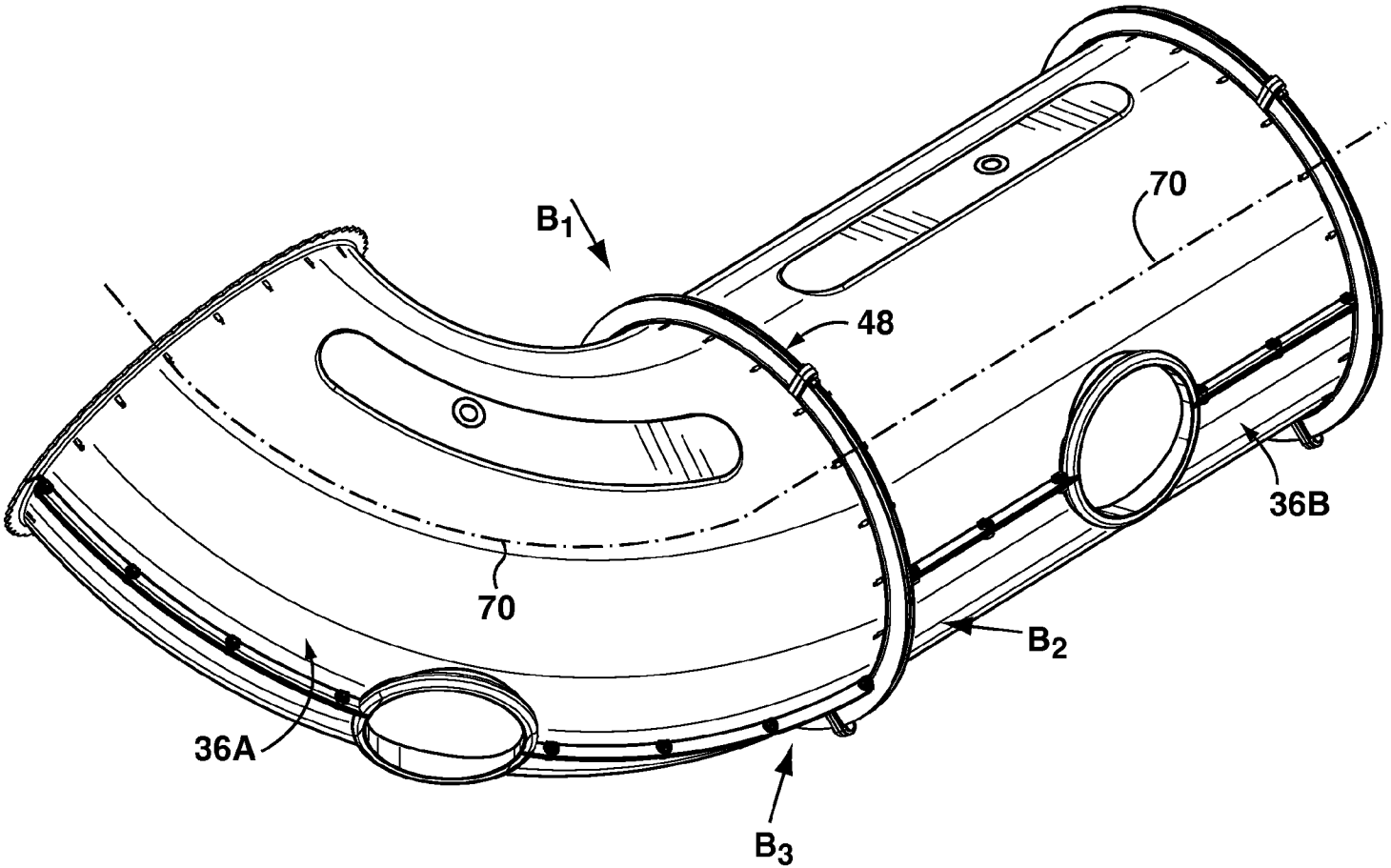
FIG. 3 is an isometric view of the two sections of FIG. 2 with the clamp ring of FIG. 2 positioned on the adjacent flanges thereof, drawn at a smaller scale.
Figure 4:
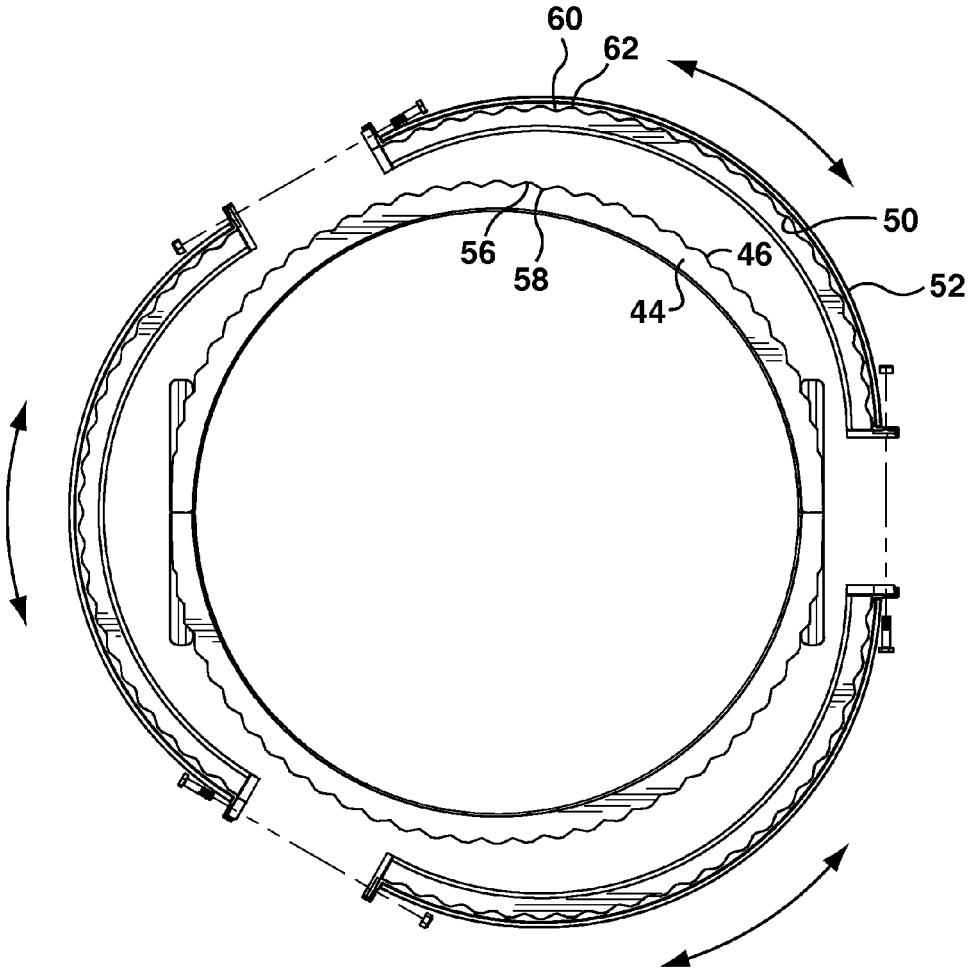
FIG. 4 is a cross-section showing a notched edge on an embodiment of a flange of the invention and a notched portion in the clamp ring of FIG. 2, drawn at a larger scale.
Figure 5:
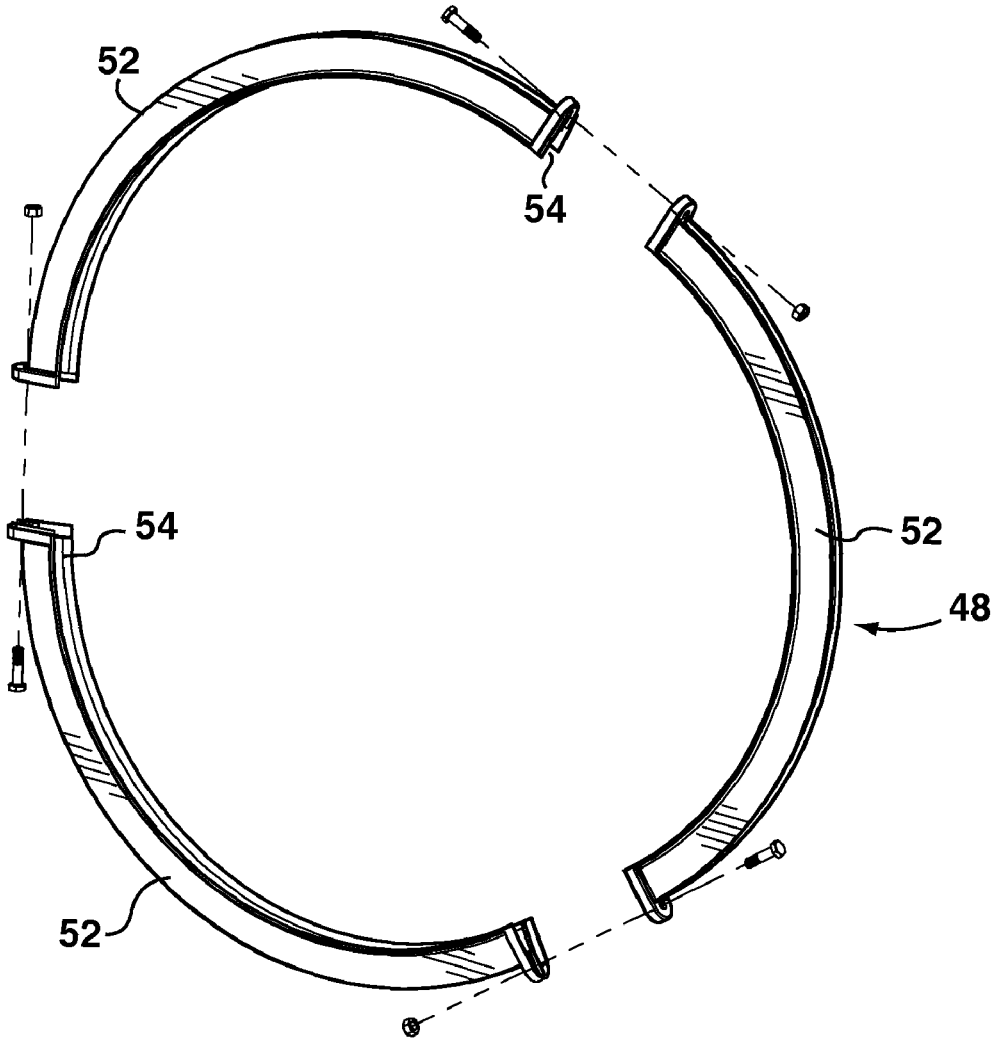
FIG. 5 is an isometric view of the clamp ring of FIG. 2.
Figure 6:
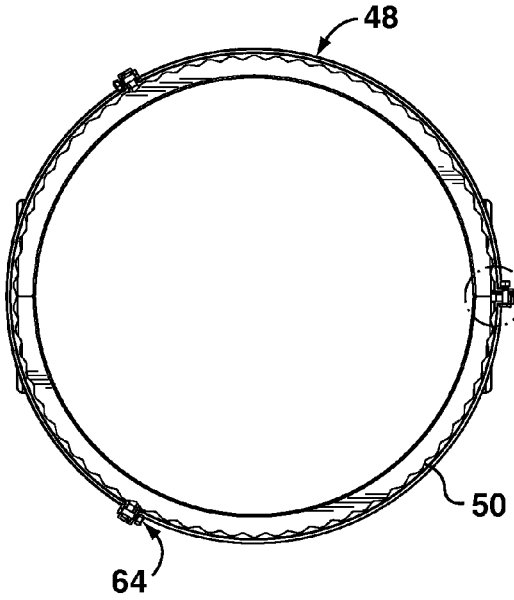
FIG. 6 is a cross-section showing the notched portion and the notched edge of FIG. 4 meshed and locked together, drawn at a smaller scale.
Figure 7:
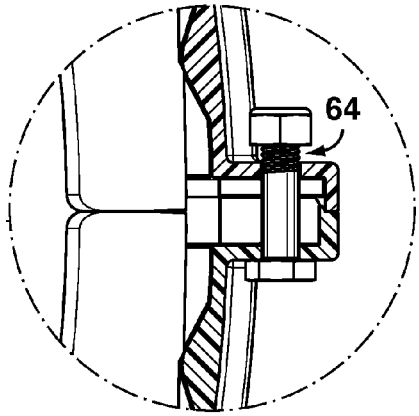
FIG. 7 is a cross-section showing an embodiment of a locking mechanism of the invention in the clamp ring of FIG. 7 in an engaged position, drawn at a larger scale.

Reference is first made to FIGS. 1-9 to describe an embodiment of an enclosed slide of the invention generally identified by the reference numeral 20. As can be seen in FIG. 1, the enclosed slide 20 extends between a deck 22 located above a ground surface 24 and the ground surface. The enclosed slide 20 includes an elongate slide bed 26 extending between a top end 28 proximal to the deck 22 and a bottom end 30 proximal to the ground surface 24. Preferably, the slide bed 26 includes a floor portion 32 and a roof portion 34 defined by a plurality of elongate sections 36. As can be seen in FIGS. 1 and 2, each section 36 preferably extends between a first end 38 and a second end 40 thereof. The sections 36 preferably are connected together in abutting end-to-end relations respectively in which two of the sections 36 are positioned end-to-end (FIGS. 1, 2, 2A). It is also preferred that each section 36 includes a body 42 defining a portion of the slide bed 26 and one or more flanges 44 extending outwardly from the body 42 and ending in a notched edge 46 (FIG. 2). The flange 44 preferably is positioned substantially at one of the ends 38, 40 (FIGS. 2, 2A). Also, the flanges 44 which are positioned at the abutting two ends 38, 40 of respective sections 36 preferably comprise a pair 47 of flanges 44 adjacent to each other. The notched edges 46 on each pair 47 of adjacent flanges are substantially aligned with each other when the sections 36 are assembled end-to-end (FIGS. 2, 2A). It is also preferred that the enclosed slide 20 includes a number of clamp rings 48. Each clamp ring 48 includes a notched portion 50 for mating with the notched edges 46 of each pair of adjacent flanges 44 respectively (FIGS. 4, 6, 7). Each clamp ring 48 is adapted for securing the adjacent flanges 44 of each pair 47 of flanges to each other respectively.

Preferably, and as can be seen in FIGS. 4 and 5, each clamp ring 48 includes one or more body segments 52 defining a slot 54 in which the pair 47 of adjacent flanges 44 are at least partially received (FIGS. 4, 6, 7). As shown in FIGS. 4, 6, and 7, the body segment 52 preferably includes the notched portion 50 in the slot 54 for mating with the notched edges 46 of the pair 47 of the adjacent flanges 44. As can be seen in FIGS. 6 and 7, the pair 47 of adjacent flanges 44 is thereby located in a predetermined aligned relation relative to each other.

Preferably, the notched edge 46 includes a number of first teeth 56. Each first tooth 56 is spaced apart from the first teeth 56 which are located proximal thereto by first notches 58. Similarly, the notched portion 50 includes a number of second teeth 60, and each second tooth 60 is spaced apart from the second teeth 60 which are located proximal thereto by second notches 62. The second teeth 60 and the second notches 62 are sized and positioned to mesh with the first teeth 56 and the first notches 58 in the notched edges 46 (FIG. 4).

As can be seen in FIG. 2A, when the pair 47 of adjacent flanges 44 are located in the predetermined relation relative to each other, such flanges are in a side-by-side relation to each other and engage each other.

Preferably, each clamp ring 48 includes one or more locking mechanisms 64 for locking the notched portion 50 of each clamp ring 48 and the notched edges 46 of each pair 47 of the flanges together, when the first teeth 56 and first notches 58 are meshed with the second notches 62 and the second teeth 60 respectively, to substantially maintain each pair 47 of adjacent flanges 44 in a predetermined relation relative to each other (FIGS. 4, 6, 7). The locking mechanism 64 preferably includes any suitable locking device. For instance, and as shown in FIGS. 6 and 7, in one embodiment, the locking mechanism is a suitable fastener, such as a nut and bolt.

As can be seen in FIGS. 4-7, each locking mechanism 64 is movable between an engaged position (FIGS. 6, 7), in which the notched portion 50 of the body segment 52 and the notched edges 46 of the pair 47 of adjacent flanges 44 are secured together, and a disengaged position (FIGS. 2, 2A, 4, 5), in which the notched portion 50 and the notched edges 46 are unsecured so that movement of the adjacent flanges 44 in the pair 47 relative to each other is permitted. Preferably, and as indicated in FIGS. 2 and 2A, when the locking mechanism 64 is in the disengaged position, rotational movement of the two abutting sections relative to each other is permitted. For instance, rotational movement of the abutting section designated as 36A in FIG. 2 is permitted relative to the section designated as 36B abutting thereto, in the directions indicated by two-ended arrow "A".

Preferably, and as shown in FIGS. 2, 2A, 12, and 13, the slide 20 also includes a number of indicators 68. Each of the indicators 68 is disposed on the body 42 of each section 36 for rotationally positioning each section 36 relative to each section 36 abutting thereto in a preselected relation relative to each other, as will be described. It is also preferred that the abutting sections are in the preselected relation relative to each other when selected ones of the indicator 68 on the two abutting sections respectively are aligned with each other.

As can be seen in FIG. 3, the slide bed 26 is generally symmetrically oriented about respective central axes 70 of the sections 36. (It will be understood that, where the section 36 is generally curved, the associated central axes 70 may also be curved.) The locking mechanisms 64 in each clamp ring 48 are adapted to urge the body segments 52 of the clamp ring 48 respectively radially inwardly (i.e., in the directions indicated by arrows $B_1$, $B_2$, and $B_3$ in FIG. 3), substantially toward the respective central axes 70 of each section 36.

Preferably, each clamp ring 48 is securable to substantially prevent movement of the abutting sections 36 relative to each other, and releasable to permit movement of the notched edges 46 of each pair 47 of adjacent flanges 44 relative to each other.

Figure 10:
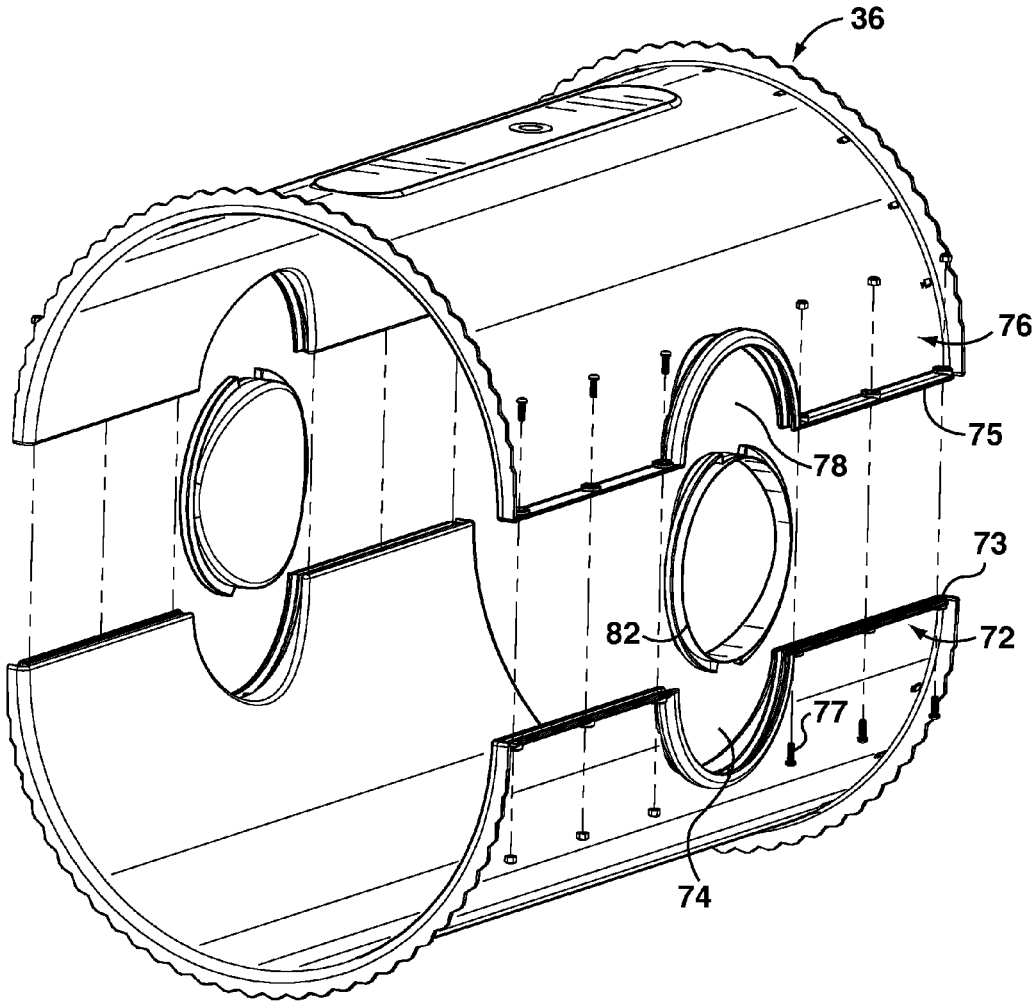
FIG. 10 is an isometric view of the top and bottom portions of an embodiment of a section of the invention in an unassembled condition, drawn at a smaller scale.
Figure 11:
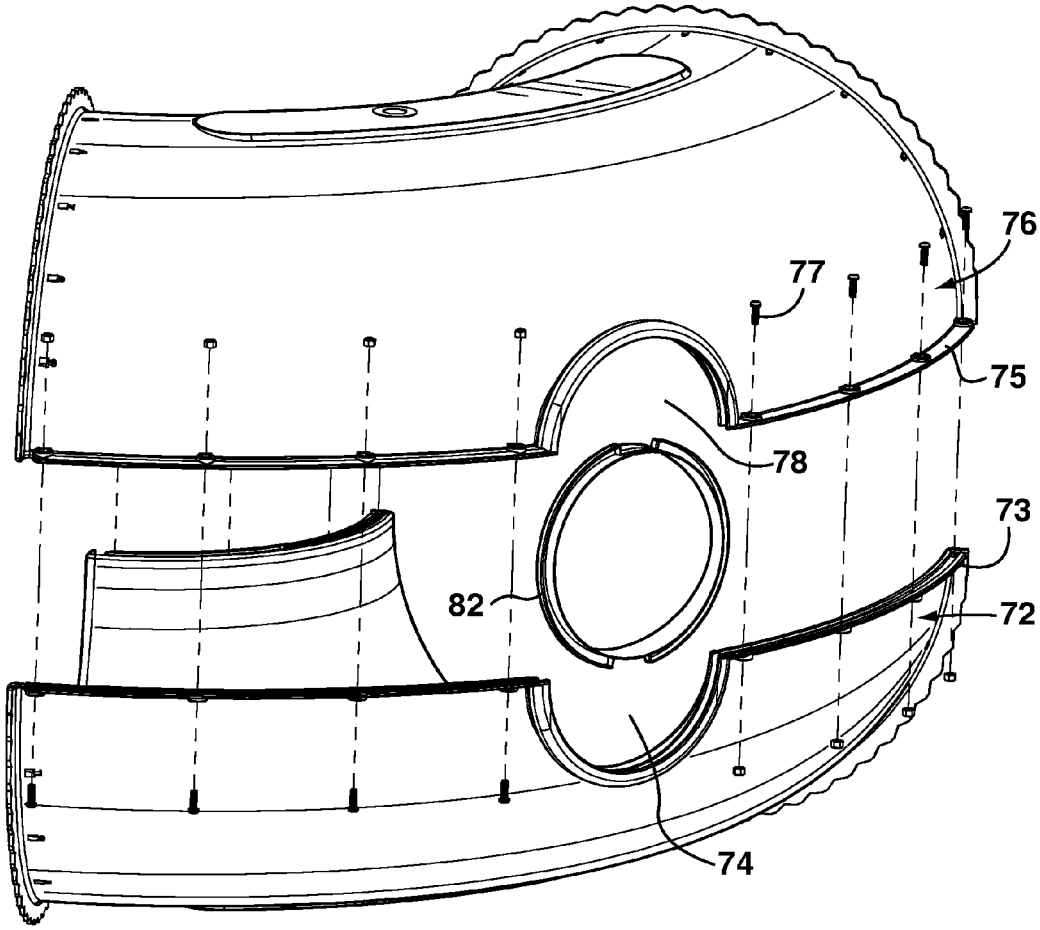
FIG. 11 is an isometric view of an alternative embodiment of a section of the invention in an unassembled condition.
Figure 12:
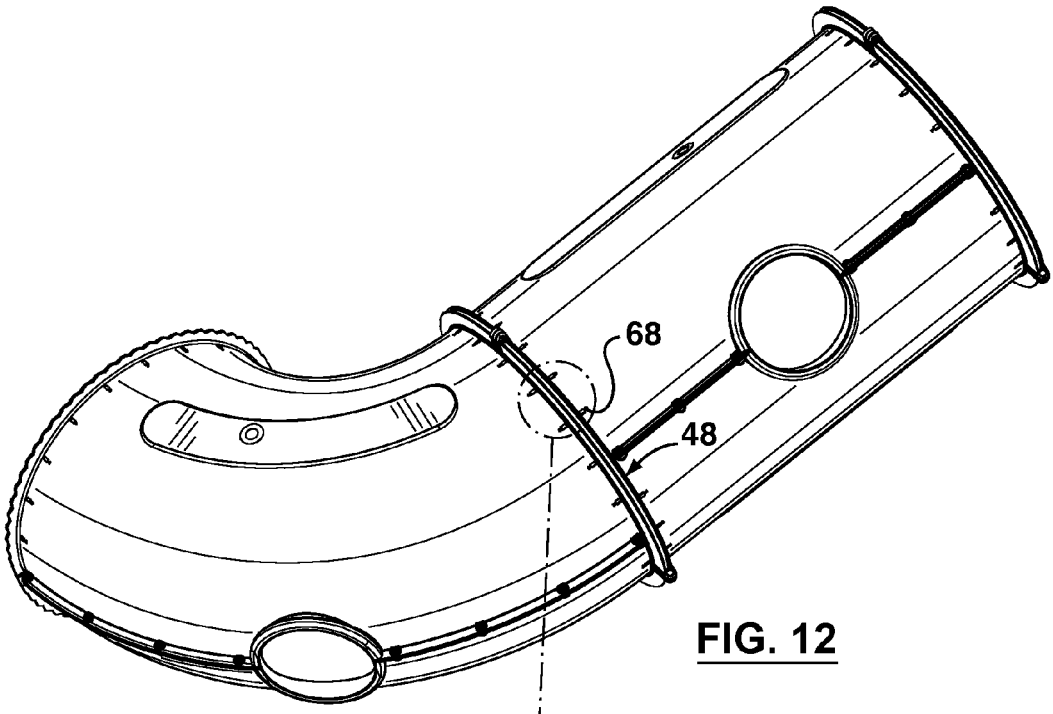
FIG. 12 is an isometric view of two abutting sections with indicators positioned on each section respectively, drawn at a smaller scale.
Figure 13:
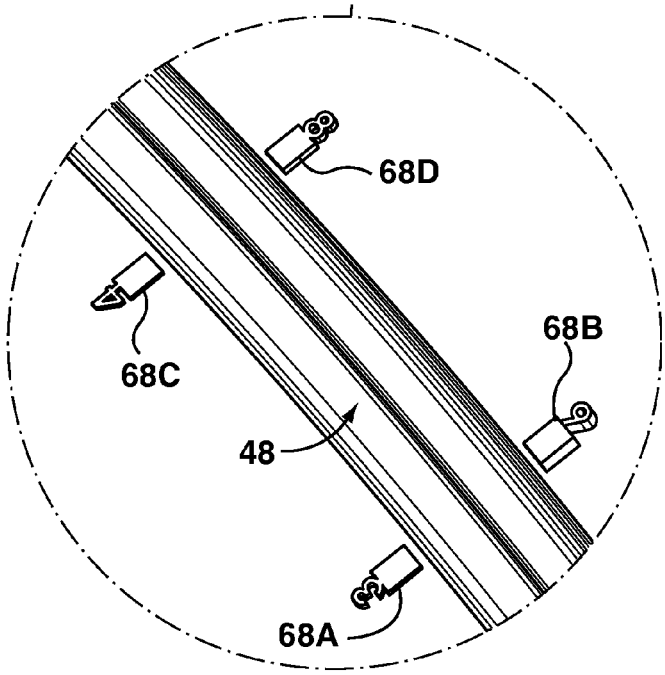
FIG. 13 is an isometric view of portions of the abutting sections of FIG. 12, drawn at a larger scale.

In one embodiment, one or more of the sections 36 includes a bottom portion 72 with one or more first aperture parts 74, and a top portion 76 with one or more second aperture parts 78. As can be seen in FIG. 10, when they are attached together, the top and bottom portions 76, 72 cooperate with each other to substantially form the body 42 of the section. Preferably, the top and bottom portions 76, 72 include respective ridges 73, 75 which are adapted to mate with each other when the top and bottom portions 76, 72 are put together. It is also preferred that the top and bottom portions 76, 72 are fastenable together by suitable fasteners 77. The first and second aperture parts 74, 78 are positioned so that when the top and bottom portions 76, 72 are attached together, the first and second aperture parts 74, 78 collectively define an aperture in which a window 82 is receivable (FIGS. 10, 11). Preferably, the window 82 allows the slide bed 26 to be at least partially illuminated by ambient light via the window 82. Also, a user (not shown) in the slide bed can look outwardly via the window 82. Accordingly, the window 82 generally results in a more enjoyable experience for the user. In one embodiment, and as can be seen in FIG. 1, the enclosed slide 20 preferably includes a number of windows 82.

Figure 8:
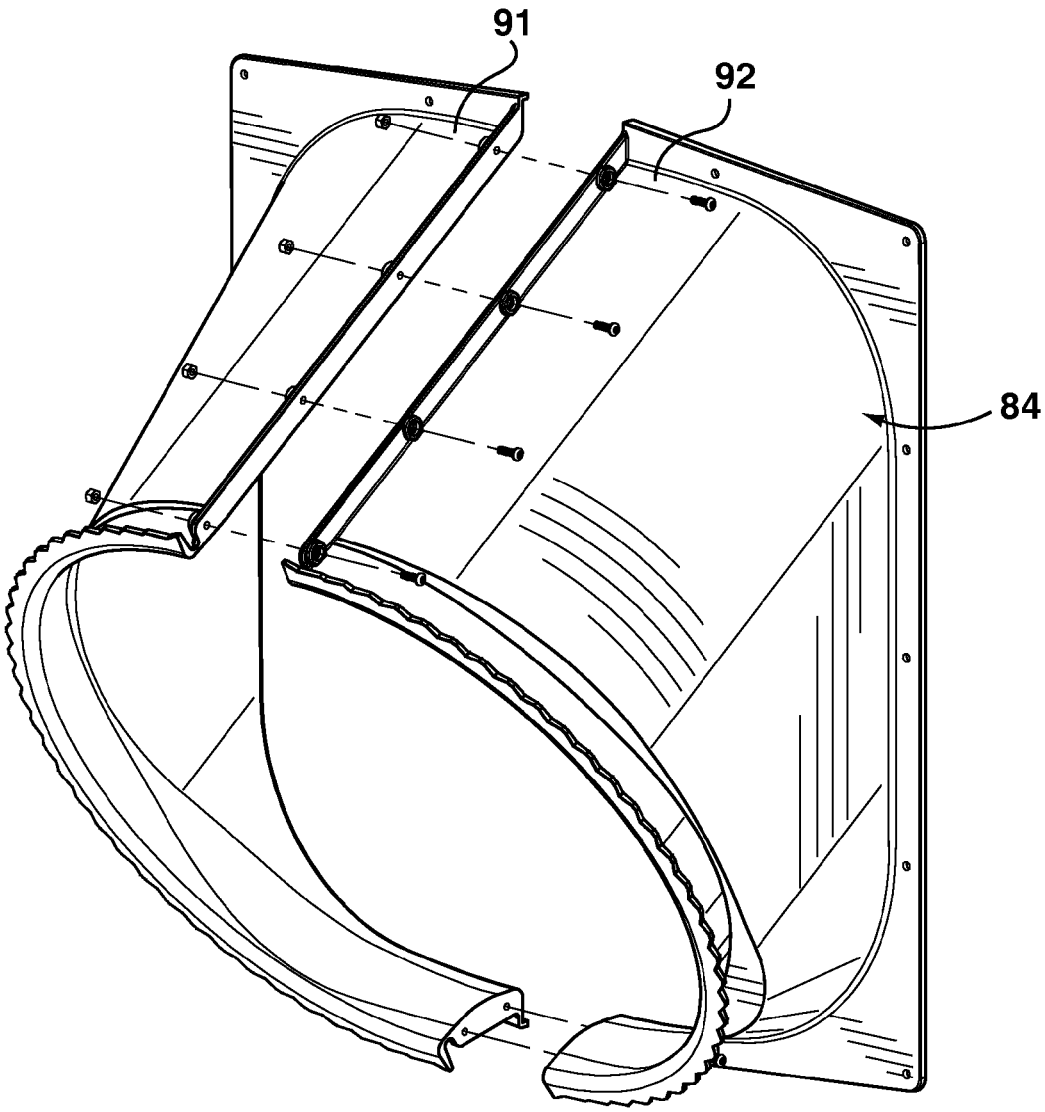
FIG. 8 is an isometric view of an embodiment of a top section of the invention in an unassembled condition, drawn at a smaller scale.
Figure 9:
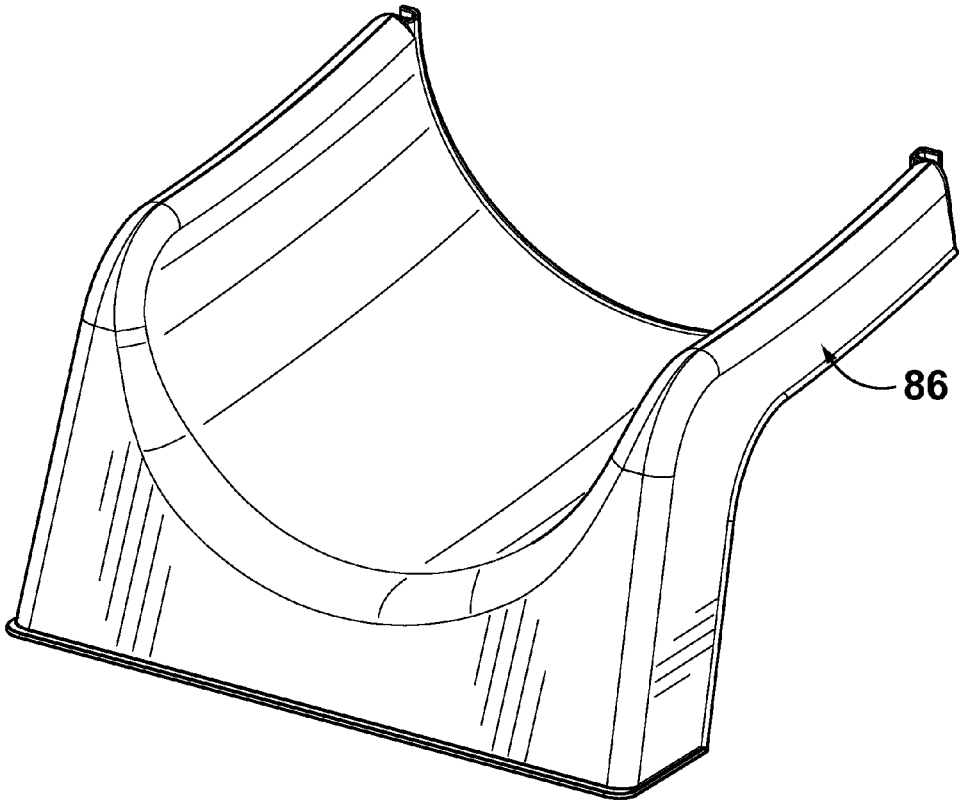
FIG. 9 is an isometric view of an embodiment of a bottom section of the invention.

Preferably, and as can be seen in FIG. 1, the sections 36 include a top section 84 which is adapted to be positioned proximal to the deck 22 and a bottom section 86 adapted to be positioned proximal to the ground surface 24. The sections 36 also include a number of connecting sections 88 (FIG. 1) which are adapted to be positioned end-to-end for connecting the top and bottom sections 84, 86. As shown in FIG. 1, the sections 36 preferably are attachable together so that the slide bed 26 defined in the connecting sections 88 is substantially continuous. Embodiments of the top and bottom sections 84, 86 are also shown in FIGS. 8 and 9. Although the top section 84 is shown as being formed of two parts 91, 92 divided substantially vertically, it will be understood that the top section 84 may alternatively be formed of one piece or of two pieces otherwise divided, as preferred.

Figure 15A:
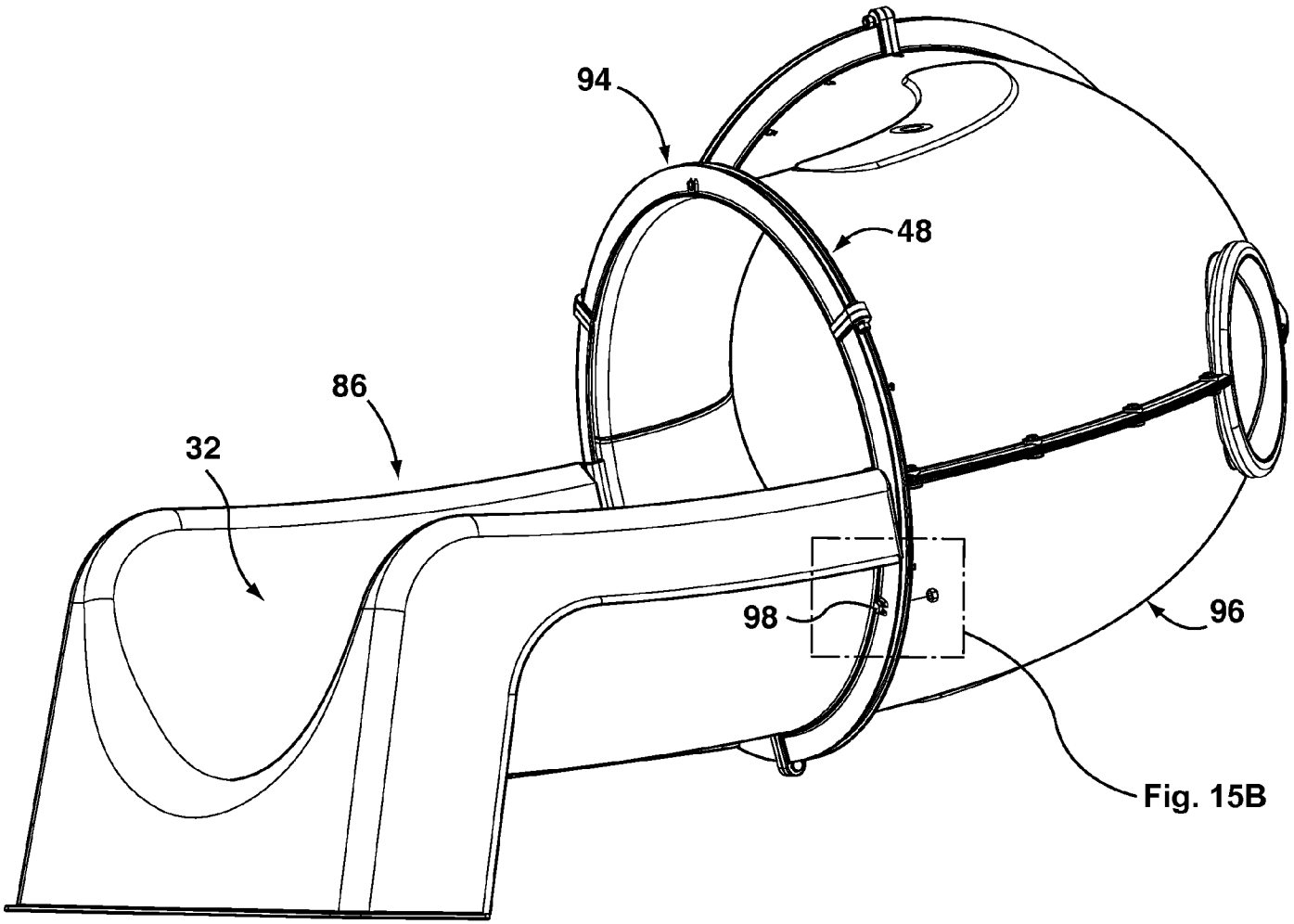
FIG. 15A is an isometric view of the bottom portion with a connecting section attached thereto, drawn at a smaller scale.
Figure 15B:
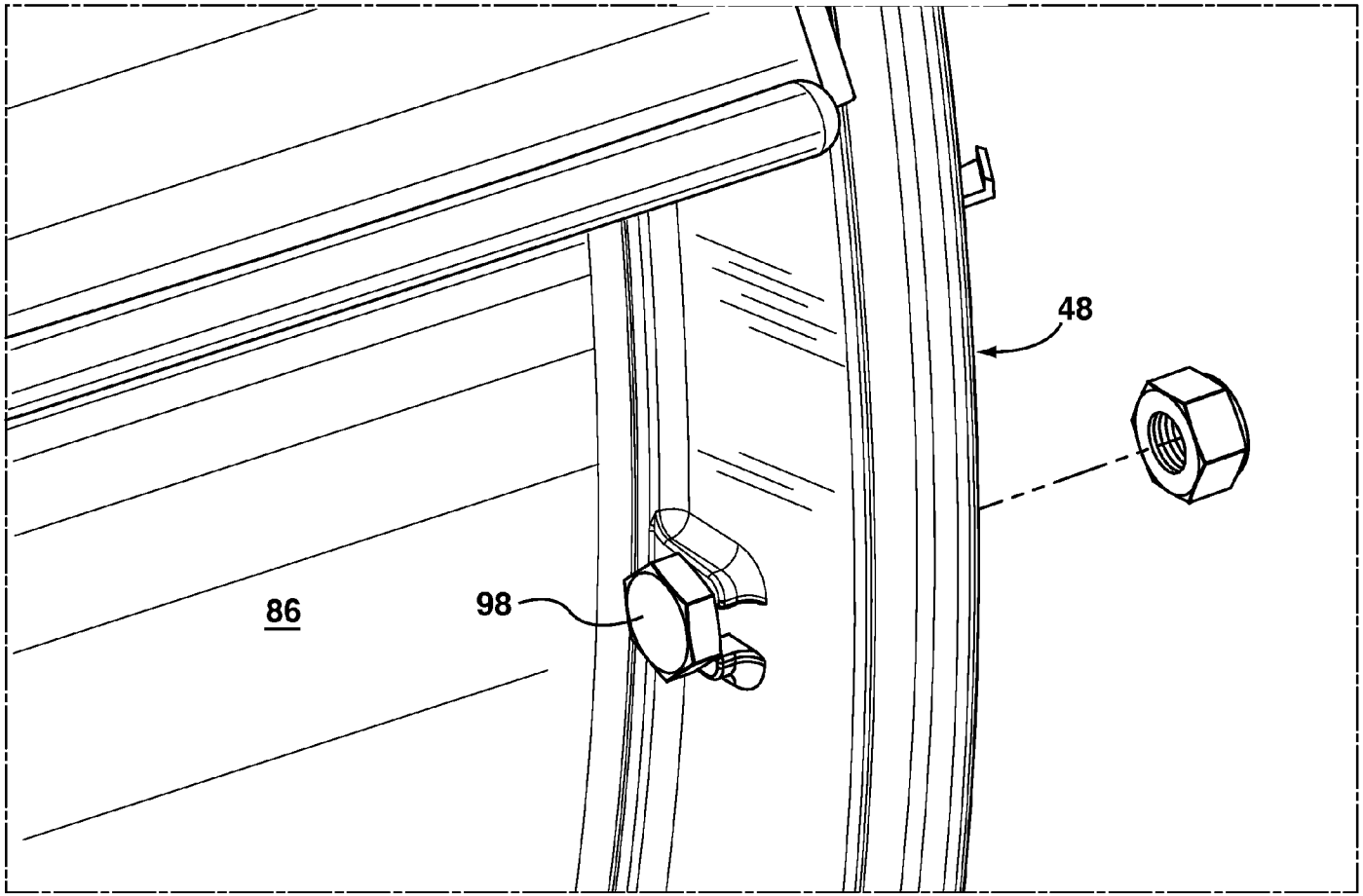
FIG. 15B is an isometric view of a portion of the bottom section showing the manner in which the bottom section is attached to the connecting section, drawn at a larger scale.

In one embodiment, the bottom section 86 includes a flange portion with a notched edge (not shown) positioned proximal to the part of the slide bed floor portion 32 defined by the bottom section 86, and abutting a flange (not shown) at an end 94 of a lowermost connecting section 96. Preferably, the abutting flange on the section 96 and the flange portion are secured together by the clamp ring 48 so that the notched edges of the flange and the flange portion are aligned. Because the flange on the bottom section 96 does not extend proximal to the roof portion of the slide bed, additional fasteners 98 are used to more securely attach the clamp ring 48, the flange, and the flange portion together. As can be seen in FIGS. 15A and 15B, each fastener 98 preferably is a nut and bolt. However, it will be understood that any suitable fasteners could be used to better secure the bottom section 86 to the lowermost connecting section 96.

The sections 36 preferably are made of any suitable material, e.g., any suitable injection molded plastic.

Figure 14:
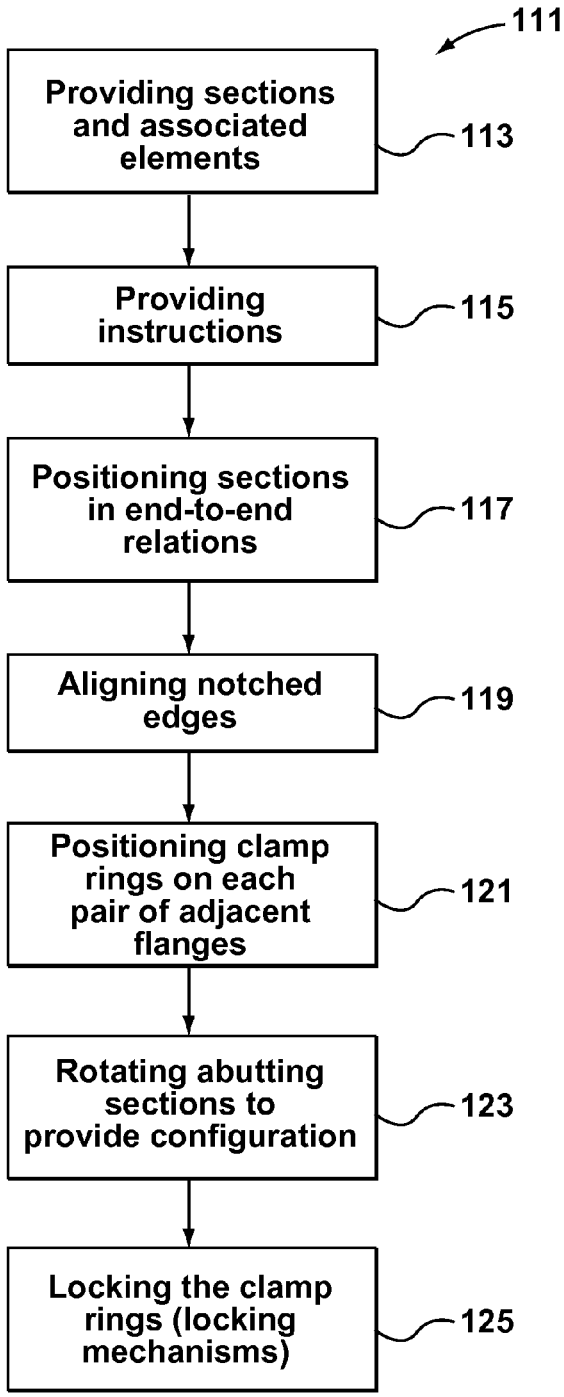
FIG. 14 is a flow chart illustrating steps of an embodiment of a method of the invention.

In use, an embodiment of the method 111 of assembling the enclosed slide 20 having a predetermined configuration and extending between the deck 22 and the ground surface 24 includes the following steps (FIG. 14). First, a number of elongate sections 36 are provided (step 113). Preferably, the slide 20 includes the top section 84 (FIGS. 1, 10), the bottom section 86 (FIGS. 1, 11), and the connecting sections 88 positioned therebetween, on assembly. As described above, each section 36 includes the body 42 extending between the first end and the second end thereof. Each of the flanges 44 is positioned substantially at one of the ends of each section.

Instructions for assembling the sections into abutting end-to-end relations to form the predetermined configuration are provided (step 115).

Next, the sections 36 are positioned in the abutting end-to-end relations respectively in accordance with such instructions (step 117). In practice, it is preferred that the bottom section 86 is first positioned relative to the deck, so that the connecting sections 88 are added as the slide is built up from the bottom section 86, i.e., each subsequent section being positioned on the immediately preceding section. Preferably, the sections are positioned in each case so that the flanges 44 positioned at each of the abutting two ends of respective sections comprise the pair 47 of the flanges which are positioned adjacent to each other. The notched edges 46 on each pair 47 of adjacent flanges preferably are then aligned (step 119). It is also preferred that such alignment is achieved by rotation of an abutting section relative to the other section abutting thereto.

For instance, the two abutting sections shown in FIGS. 2 and 2A (designated 36A and 36B for convenience) are positioned abutting each other, before the clamp ring 48 is positioned on the pair 47 of flanges. For convenience, the flange on section 36A is designated 44A, and the flange on section 36B is designated 44B (FIG. 2A). As can be seen in FIG. 2A, the teeth and the troughs therebetween on one of the flanges preferably are aligned (i.e., along axes "X" and "Y" indicated in FIG. 2A).

In the next step, the clamp rings 48 are provided, and positioned on the pairs of flanges (step 121). The clamp rings 48 are for securing each flange in the pair 47 of flanges to the other (i.e., adjacent) flange of the pair 47. As described above, each clamp ring 48 includes one or more notched portions 50 for mating with the notched edges 46 of each pair 47 of adjacent flanges respectively.

Preferably, the locking mechanisms 64 in the clamp ring 48 are unlocked when the clamp ring is first positioned on the pair 47 of flanges, so that each of the body segments 52 is loosely positionable on the pair 47 of adjacent flanges. It is also preferred that relative movement of an abutting section (i.e., relative to the section(s) abutting thereto) is permitted, while the locking mechanisms are unlocked. Accordingly, after the clamp ring 48 is loosely positioned on the pair 47 of adjacent flanges, one of the abutting sections is rotatable relative to the other abutting section (i.e., in the directions indicated by arrow "A" in FIG. 2) so that the abutting sections are aligned as preferred before the locking mechanisms 64 on the clamp ring 48 are locked (step 123). (It will be understood that the rotation of an abutting section after the clamp ring has been loosely positioned on the pair 47 is not needed if the abutting sections are aligned as desired before the clamp ring is positioned on the pair.)

Ultimately, each clamp ring 48 is positioned on each pair 47 of adjacent flanges respectively, as described above, so that the notched edges 46 mate with the notched portion 50 in each clamp ring 48 respectively, as described above. In this way, the clamp rings 48 locate each pair 47 of flanges in a predetermined aligned relationship relative to each other.

Preferably, the notched portion 50 of each clamp ring 48 is locked with the notched edges 46 of each pair 47 of adjacent flanges respectively (step 125). As described above, this is preferably achieved by means of locking one or more locking mechanisms 64 which are provided in each clamp ring 48.

As described above, the sections preferably include indicators 68 positioned thereon, to facilitate positioning of each section relative to an abutting section, e.g., in accordance with the instructions, to result in the predetermined configuration. For instance, in FIGS. 12 and 13, indicators 68A and 68B are shown aligned with each other, as are indicators 68C and 68D. It can be seen in FIG. 2A that the user can readily position the abutting sections as desired to achieve the predetermined configuration by aligning the respective indicators.

Any element in a claim that does not explicitly state "means for" performing a specified function, or "step for" performing a specific function, is not to be interpreted as a "means" or a "step" clause as specified in 35 U.S.C. §112, paragraph 6.

It will be appreciated by those skilled in the art that the invention can take many forms, and that such forms are within the scope of the invention as claimed. Therefore, the spirit and scope of the appended claims should not be limited to the descriptions of the preferred versions contained herein.

I claim:

1. An enclosed slide extending between a deck located above a ground surface and the ground surface, the enclosed slide comprising:

an elongate slide bed extending between a top end thereof proximal to the deck and a bottom end thereof proximal to the ground surface, the slide bed comprising a floor portion and a roof portion defined by a plurality of elongate sections, each said section extending between a first end and a second end, said sections being connected together in abutting end-to-end relations respectively in which two of said sections are positioned end-to-end;

each said section comprising a body defining a portion of the slide bed and at least one flange extending outwardly from the body and ending in a notched edge, said at least one flange being positioned substantially at one of said ends;

said flanges positioned at each said abutting two ends of respective sections comprising a pair of said flanges adjacent to each other, and said notched edges on each said pair of said adjacent flanges being substantially aligned with each other; and a plurality of clamp rings, each said clamp ring comprising at least one notched portion for mating with the notched edges of each said pair of said adjacent flanges respectively, each said clamp ring being adapted for securing said adjacent flanges in each said pair to each other respectively.

2. An enclosed slide according to claim 1 in which each said clamp ring comprises at least one body segment defining at least one slot in which said pair of said adjacent flanges are at least partially received, said at least one body segment comprising said at least one notched portion in said at least one slot for mating with the notched edges of said pair of said adjacent flanges, to locate said pair of said adjacent flanges in a predetermined aligned relation relative to each other.

3. An enclosed slide according to claim 1 in which each said notched edge comprises a plurality of first teeth, each said first tooth being spaced apart from said first teeth proximal thereto by first notches, and in which said at least one notched portion comprises a plurality of second teeth, each said second tooth being spaced apart from said second teeth proximal thereto by second notches, said second teeth and said second notches being sized and positioned to mesh with said first teeth and said first notches in said notched edges.

4. An enclosed slide according to claim 1 in which, when said pair of said adjacent flanges are located in the predetermined relation relative to each other, said pair of said adjacent flanges are in a side-by-side relation to each other and engage each other.

5. An enclosed slide according to claim 1 in which each said clamp ring comprises at least one locking mechanism for locking said at least one notched portion of each said clamp ring and the notched edges of each said pair of said adjacent flanges together when said first teeth and said first notches are meshed with said second notches and said second teeth respectively, to substantially maintain each said pair of said adjacent flanges in a predetermined relation relative to each other.

6. An enclosed slide according to claim 5 in which each said clamp ring comprises a plurality of body segments positioned in end-to-end relation to each other.

7. An enclosed slide according to claim 5 in which each said at least one locking mechanism is movable between an engaged position, in which said at least one notched portion of said at least one body segment and the notched edges of said pair of said adjacent flanges are secured together, and a disengaged position, in which said at least one notched portion and the notched edges are unsecured such that movement of said adjacent flanges in said pair relative to each other is permitted.

8. An enclosed slide according to claim 7 in which, when said at least one locking mechanism is in the disengaged position, rotational movement of said two abutting sections relative to each other is permitted.

9. An enclosed slide according to claim 7 additionally comprising a plurality of indicators disposed on the body of each said section for rotationally positioning each said section relative to each said section abutting thereto in a preselected relation relative to each other.

10. An enclosed slide according to claim 9 in which said abutting sections are in the preselected relation relative to each other when selected ones of the indicators on said two abutting sections respectively are aligned with each other.

11. An enclosed slide according to claim 8 in which the slide bed is substantially defined by respective central axes of said sections and said at least one locking mechanism in each said clamp ring is adapted to urge the body segments of each said clamp ring respectively radially inwardly, substantially toward the respective central axes of each said section.

12. An enclosed slide according to claim 1 in which each said clamp ring is securable to substantially prevent movement of said two abutting sections relative to each other and releasable to permit movement of said notched edges of said pair of said adjacent flanges relative to each other.

13. An enclosed slide according to claim 12 additionally comprising a plurality of indicators positioned on each said section, said indicators being positioned such that said indicators on said two abutting sections are alignable to locate said two adjacent flanges in the predetermined relation relative to each other.

14. An enclosed slide according to claim 1 in which at least a selected one of said sections comprises a bottom portion with at least one first aperture part and a top portion with at least one second aperture part, said at least one first and second aperture parts being positioned such that when the top and bottom portions are attached together, said at least one first and second aperture parts collectively define an aperture in which a window is receivable.

15. An enclosed slide according to claim 14 in which said selected section comprises the window received in the aperture.

16. An enclosed slide according to claim 1 in which said sections comprise:

a top section, adapted to be positioned proximal to the deck;

a bottom section, adapted to be positioned proximal to the ground surface; and a plurality of connecting sections adapted to be positioned end-to-end for connecting the top and bottom sections.

17. An enclosed slide according to claim 16 in which each said section comprises a plurality of portions which are attachable together such that the slide bed defined in said sections is substantially continuous.

18. A method of assembling an enclosed slide with a predetermined configuration and extending between a deck located above a ground surface and the ground surface, the method comprising:

(a) providing a plurality of elongate sections, each said section extending between a first end and a second end, each said section comprising a body and at least one flange extending outwardly from the body and ending in a notched edge, said at least one flange being positioned substantially at one of said ends, said sections being connectable together in abutting end-to-end relations respectively in which two of said sections are positioned end-to-end;

(b) providing instructions for assembling said sections into abutting end-to-end relations to form the predetermined configuration;

(c) pursuant to said instructions, positioning said sections in said abutting end-to-end relations respectively such that said flanges positioned at each said abutting two ends of respective sections comprise a pair of said flanges adjacent to each other;

(d) aligning said notched edges on each said pair of said adjacent flanges respectively;

(e) providing a plurality of clamp rings for securing each respective said pair of said adjacent flanges to each other, each said clamp ring comprising at least one notched portion for mating with the notched edges of each said pair of said adjacent flanges respectively; and (f) positioning each said clamp ring on each of said pairs of said adjacent flanges respectively, such that the notched edges of said pairs of adjacent flanges mate with said at least one notched portion in each said clamp ring respectively, to locate each said pair of flanges in a predetermined aligned relation relative to each other.

19. A method according to claim 18 additionally comprising:

(g) locking said at least one notched portion of each said clamp ring with the notched edges of each said pair of adjacent flanges respectively.

20. A kit of parts for an enclosed slide with a predetermined configuration comprising:

a plurality of elongate sections, each said section extending between a first end and second end, said sections being connectable together in abutting end-to-end relations respectively in which two of said sections are positioned end-to-end, said sections comprising a slide bed when connected together;

each said section comprising a body defining a portion of the slide bed and at least one flange extending outwardly from the body and ending in a notched edge, said at least one flange being positioned substantially at one of said ends, said flanges positioned at each set of abutting two ends of respective sections comprising a pair of said flanges adjacent to each other, and said notched edges on each said pair of said adjacent flanges being substantially alignable with each other;

a plurality of clamp rings, each said clamp ring comprising at least one notched portion for mating with the notched edges of each said pair of said adjacent flanges respectively, each said clamp ring being adapted for securing each said pair of said adjacent flanges to each other respectively; and instructions for connecting said sections in abutting end-to-end relations to form the predetermined configuration.

* * * * *